US005271157A

United States Patent [19]

Wieninger et al.

[11] Patent Number: 5,271,157

[45] Date of Patent: Dec. 21, 1993

[54] GUIDE BAR A FOR CHAIN SAW

[75] Inventors: Klaus Wieninger, Waiblingen; Walter Sattelmaier, Ludwigsburg; David Mitrega, Winnenden, all of Fed. Rep. of Germany

[73] Assignee: Andres Stihl, Waiblingen, Fed. Rep. of Germany

[21] Appl. No.: 851,196

[22] Filed: Mar. 13, 1992

[30] Foreign Application Priority Data

Mar. 16, 1991 [DE] Fed. Rep. of Germany ..... 4108663

[51] Int. Cl.[5] ..... B27B 17/02

[52] U.S. Cl. ..... 30/387; 30/383

[58] Field of Search ..... 30/384, 387, 383, 382; 83/821, 824, 820

[56] References Cited

U.S. PATENT DOCUMENTS

| | | | |
|---|---|---|---|
| 3,545,505 | 12/1970 | DeWesse et al. | 83/821 |
| 4,641,432 | 2/1987 | Kume | 30/387 |
| 4,654,972 | 4/1987 | Sellmarier et al. | 30/387 |
| 4,693,007 | 9/1987 | Apfel et al. | 30/387 |
| 4,794,696 | 1/1989 | Apfel et al. | 30/387 |
| 4,903,410 | 2/1990 | Wieninger et al. | 30/387 |
| 4,956,918 | 9/1990 | Beyer | 30/387 |
| 5,014,435 | 5/1991 | Date et al. | 30/383 |
| 5,025,561 | 6/1991 | Sugihara et al. | 30/383 |
| 5,035,058 | 7/1991 | Date et al. | 30/383 |

*Primary Examiner*—Douglas D. Watts
*Assistant Examiner*—Hwei-Siu Payer
*Attorney, Agent, or Firm*—Walter Ottesen

[57] ABSTRACT

The invention is directed to a guide bar for portable motor-driven chain saws. The guide bar includes two steel side parts and a center part connected to the side parts. The weight of the guide bar is kept optimally low while at the same time providing adequate stability and the longest possible service life by providing cutouts extending in the longitudinal direction which are provided with a filler of a material having a lower specific gravity. The cutouts of the side parts and the cutout in the center part filled likewise with a lighter material are arranged so as to not coincide with each other when the guide bar is assembled. In this way, a form-tight mounting for the filler is formed in the side parts and in the center part.

28 Claims, 7 Drawing Sheets

GUIDE BAR A FOR CHAIN SAW

FIELD OF THE INVENTION

The invention relates to a guide bar for a motor-driven chain saw and includes two side parts and a center part which are tightly connected to each other such as by welding or cementing.

BACKGROUND OF THE INVENTION

U.S. Pat. No. 4,903,410 discloses a guide bar of the kind referred to above wherein longitudinal cutouts are provided in the side parts for saving weight. These cutouts are filled out with a bonded fiber insert with the insert itself defining the center part disposed between the two side parts. The outer parts are made of steel and are connected to each other at several locations by electrowelding. Form parts which can be electrowelded are arranged between the two side parts with the thickness of the form parts corresponding approximately to the thickness of the spacer plate made of non-conducting material. The form parts are arranged at approximately equal spacings in a row one behind the other and extend through round cutouts which are provided in the peripheral region of the spacer plate defining the center part. These form parts have the task of establishing the electrical connection between the side plates made of steel in order that a trouble-free electric welding of the two side plates is obtained. The center spacer plate is made of a glass fiber bonded material and is disposed between the side plates. The spacer plate is held with the aid of electrically conducting bolts which extend through the spacer plate. This configuration leads to a comparatively large weight reduction while providing satisfactory stability of the bar. However, this configuration has the disadvantage that its manufacture is relatively expensive. The production is especially expensive because of the required form parts (such as steel bolts) that extend through corresponding openings of the center part and which are to be seated between the side parts.

U.S. Pat. No. 3,545,505 discloses another guide bar which likewise comprises two side parts lying in spaced relationship to each other which have round openings disposed close to each other along the greatest part of their respective lengths for the purpose of saving weight. The center part of this known bar is made of plastic which also fills out the round cutouts in the two side parts with the round cutouts having undercuts in the side parts by means of which the injected plastic layer is held tightly between the side plates. In this embodiment, it is disadvantageous that the injected plastic center part also defines the connection to the side plates and this connection does not permanently withstand the high stresses which act on the guide bar when working with the chain saw. These stresses are produced by bending and/or transverse forces.

SUMMARY OF THE INVENTION

It is an object of the invention to provide a guide bar which has an optimally low weight while providing adequate stability with a longer service life and which is at the same time inexpensive to manufacture.

The guide bar of the invention is for a motor-driven chain saw. The guide bar includes: first and second side parts; a center part disposed between the first and second side parts; joining means for joining the parts together in a sandwich configuration; the first side part having a first cutout formed therein and having a first inner peripheral edge defining the first cutout; the center part having a center cutout formed therein and having a center inner peripheral edge defining the center cutout; the second side part having a second cutout formed therein and having a second inner peripheral edge defining the second cutout; a filler filling out the cutouts and being made of a material lighter than the material of the side parts; and, the peripheral edges being disposed one adjacent the other so as to be incongruent with respect to each other to conjointly define holding means for holding the filler in the parts.

The cutouts in the side parts are filled with a light material such as thermoplastic plastic or thermoset plastic or aluminum. The cutouts in the side parts and in the center part are not aligned to each other in the assembled condition of the guide bar. For this reason, the center part can be simply and easily held between the side parts together with the filler made of lightweight material in a form-tight manner without special attachment means such as bolts or the like being necessary. The stamped side parts are made of high-grade steel and these side parts together with the center part can be directly welded to each other or can be connected to each other in some other manner such as using adhesive. This direct connection of the three bar parts saves cost because it can be spot or line electrowelded.

The trouble-free welding of the center part including the filler between the two side parts and its direct connection via electrowelding further makes possible that the cutouts in the three parts can be configured to extend over a largest possible length of the guide bar preferably continuously and without interruption. Furthermore, the side parts and the center part can be configured as frames for the purpose of optimal weight savings and for the adequate stability of the bar. The center longitudinal sections of these parts can be formed by narrow struts having a width of only a few millimeters with this width being less than the width of the cutouts in the side parts or in the center part. The filler of these cutouts is made out of thermoplastic plastic or thermoset plastic material and is injected or is seated as a finished part. The filler imparts additional stability to the frame-shaped steel side parts and the steel center part and attenuates vibration. It is advantageous that this filler of the center part is of the same material as the filler in both side parts. The outer surfaces of the filler can be absolutely even with the respective outer surfaces of the stamped side parts to thereby prevent additional friction when cutting in wood.

However, it is also possible to set back the outer surface of the filler by a fraction of a millimeter with respect to the outer surface of the stamped side parts with this offset being just so much that an inscription (logo) can be applied to the outer surface of the filler with the inscription running planar with or in the plane of the two side part outer surfaces so that unwanted friction is prevented even when such an inscription is applied. The slight recess of the outer surfaces of the filler, comprised preferably of plastic, has the advantage that the applied inscription does not come into direct contact with the cutting faces of the wood and thereby is not subjected to direct wear. The inscription can be applied to the outer surface of the plastic filler or be imprinted therein.

It is another object of the invention to provide a method which is suitable for producing the guide bar of the invention but also for producing other configurations of guide bars insofar as the filler is made of a free-flowing material such as thermoplastic plastic and the guide bar is assembled from at least two and preferably three steel parts. According to the invention, after the side walls and the center part are stamped, these are first directly joined to each other by means of spot or line electrowelding and thereafter the liquid plastic is injected. In this way, special configurations of the center part for mounting the filler are rendered unnecessary in advance of the assembly of the three frame-shaped parts of the bar. Such holders are required to hold the plastic filler in the center part in advance of the assembly of the three frame parts of the bar before (after hardening of the plastic) the side parts and the center part are joined fixedly to each other by means of spot or line welding.

A further embodiment of the guide bar relates especially to a guide bar made of two side parts and a center part joined to the side parts by electrowelding. In this guide bar, all parts have at least one cutout filled with a specific light material and the cutouts of the side parts are arranged so that they do not coincide with the cutout in the center part. This advantageous embodiment comprises that the two side parts are welded toward the center part with spot and line projections in the area of the longitudinal center axis of the guide bar and the electroweld is applied only in the region of these spot and/or line-shaped projections. In a preferred embodiment, the spot-shaped projections are configured so as to be elongated or elongated as well as oval such that the longer axis thereof runs at least approximately in the longitudinal direction of the guide bar. With such projections, the thermal influence zones during the welding operation are limited to the spot or line-shaped projection. This is especially the case when the plastic filler is injected or positioned in the center part in advance of welding the three bar parts. In this way, the thermal influence zones can be held narrow. These elongated projections permit the narrow frame-like side parts and the center part to be configured as narrow as possible without it being necessary to consider the weld procedure itself. This permits the cutouts in the three stamped parts of the guide bar to be configured optimally large without consideration as to the weld procedure because the cutouts can be positioned at the periphery insofar as the strength of the material will allow, that is, at the outer edge of the guide bar, this being possible because of the elongated projections. In lieu of a plurality of individual round or elongated projections, a line-shaped configuration of the projection can also be considered.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
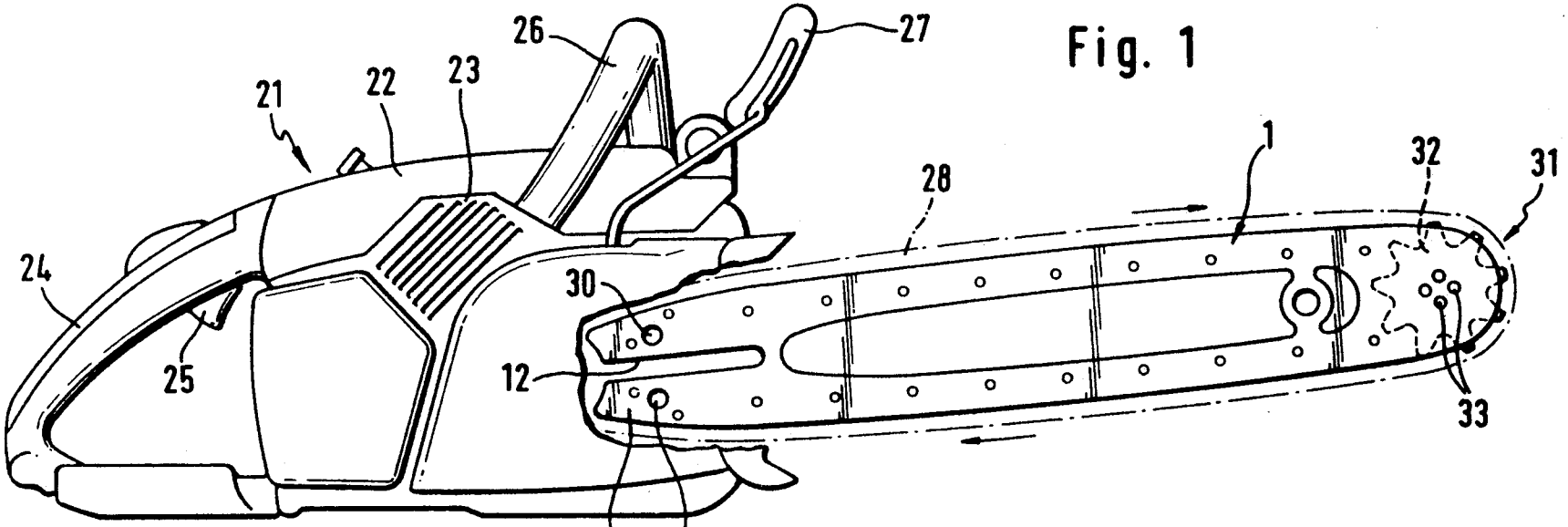
FIG. 1 is a schematic of a motor-driven chain saw equipped with a guide bar having two frame-like side parts and a frame-like center part disposed therebetween. The center part has an elongated cutout in the center region of the guide bar which is filled with a light material.

The motor-driven chain saw 21 of FIG. 1 includes a housing 22 having a drive motor 23. The housing includes a rear handle 24 with a throttle lever 25 and a forward handle 26 with a protector 27 mounted forward of the handle 26. The guide bar 1 is detachably mounted to the forward part of the motor housing 22. A saw chain 28 is driven by the drive motor 23.

At the rearward end of the guide bar at reference numeral 29, a slot 12 as well as two attachment holes 30 are provided to permit a one-sided attachment of the guide bar 1 to the housing 22 with the aid of bolts. The saw chain 28 is redirected at the forward free end 31 of the guide bar. For this purpose, a nose sprocket 32 is provided which is journalled with the aid of attachment rivets 33 between the side plates (2, 2') ahead of the center part 3 of the bar. The saw chain 28 is guided in a peripheral groove 34 which is formed by the spacing of the two side parts (2, 2') and the base of this groove is formed by the outer edge 3*b* of the center part 3.

The guide bar then comprises two side parts (2, 2') and a center part 3 connected thereto. The two side parts (2, 2') have respective cutouts (4, 4') which extend almost over the entire length of the bar. The inner peripheral edge of the cutouts is identified by reference numeral 2*a* and the outer peripheral edge by reference numeral 2*b*. The outer peripheral edges (2*b*, 2*b*) also define the guide path for the saw chain 28 which engages with its center links in the guide groove 34 and which runs on the outer edge 3*b* of the center part 3 likewise made of steel.

The center part 3 likewise has a cutout 5 extending over almost the entire length of the guide bar. The cutouts 4, 4' and 5 are made optimally large for reducing weight and are filled with a filler 6 made of a specific light material such as thermoplastic plastic, thermoset plastic, aluminum or the like. The cutouts are filled with this filler 6 for reasons of stability. The cutouts 4, 4' and 5 can be uninterrupted or they can be interrupted by connecting transverse struts.

A compact assembly of the side parts (2, 2') with the center part 3 including filler 6 can be obtained which is simple to manufacture. This is achieved according to the invention by providing that the cutouts (4, 4') of the side parts (2, 2') are congruent or coincidental to each other and incongruent or non-coincidental to the cutout 5 in the center part 3, which is also filled with light material, in the assembled condition of the guide bar; that is, the cutouts do not precisely overlap whereby a simple and form-tight mounting of the common filler for the cutouts 4, 4' and 5 is obtained.

Figure 1B:
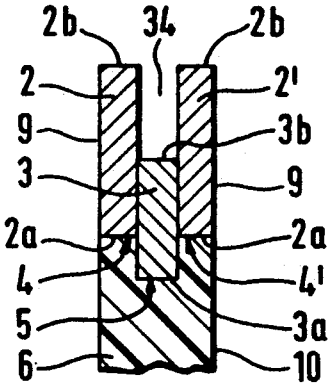
FIG. 1*b* is an embodiment of the guide bar wherein the center part has a smaller cutout than the cutouts in the side parts such that the steel frame of the center part is held in a tongue-and-groove-like manner in the filler of the cutout.
Figure 1A:
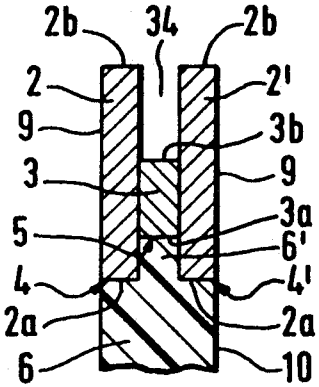
FIG. 1*a* is a section view of an embodiment of the guide bar wherein the elongated cutouts in the side parts are smaller than the elongated cutout in the center part such that the filler made of a light material is held with a flange-like projection or rim between the two side parts.
Figure 2:
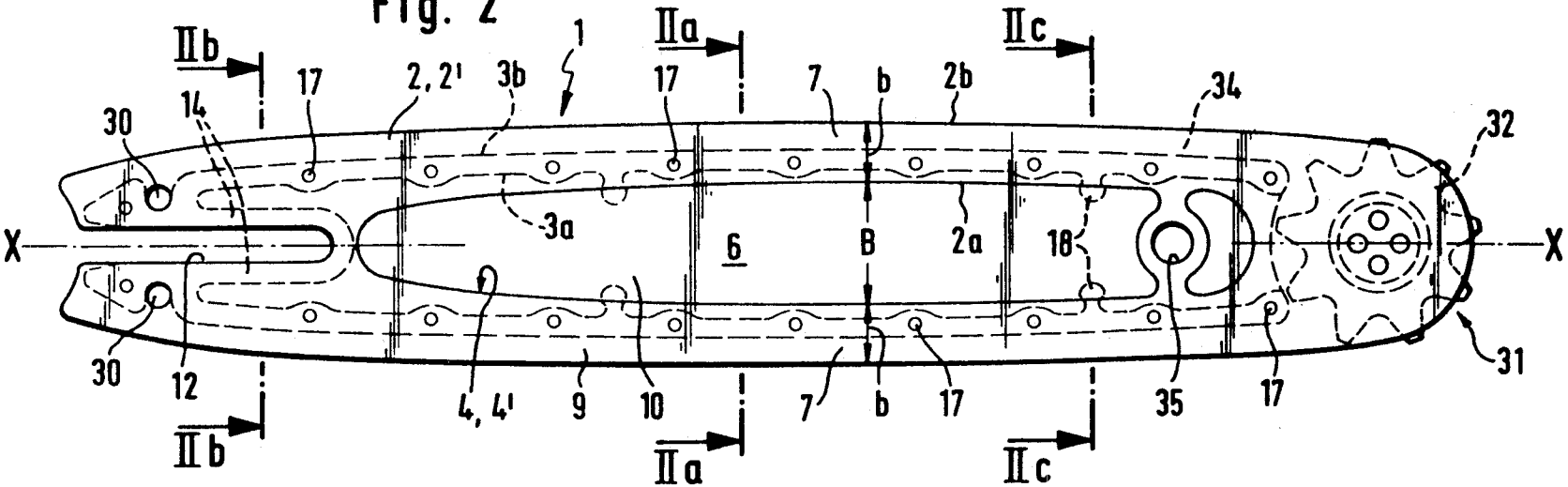
FIG. 2 is a side elevation view of the guide bar having a plastic filler and the three parts being spot-welded together.
Figure 2C:
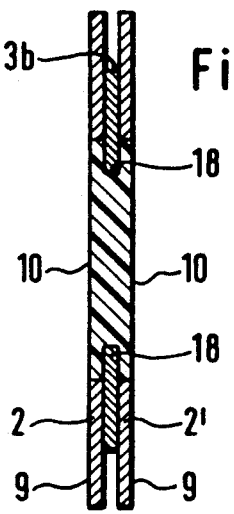
FIG. 2*c* is a section view taken along line IIc—IIc of FIG. 2.

In the embodiment of FIGS. 1*a* and 2, the cutout 5 of the center part 3 is made larger than the cutouts (4, 4') in the respective side parts (2, 2') whereby the filler 6 is held in a form-tight manner with a flange-like projection 6' between the side parts 2, 2' and the inner edge 3*a* of the center part 3. The flange-like projection 6' can be continuous or interrupted.

A corresponding form-tight fixed mounting of the filler 6 is obtained according to another embodiment of the invention (see FIG. 1*b*) when the cutout 5 in the center part 3 is smaller than the cutouts (4, 4') in the respective side parts (2, 2') in such a manner that the center part 3 is joined with its inner edge region 3*a* at least partially to the filler 6 with a tongue-and-groove-like connection. This connection is configured such that the center part 3 (as shown in FIG. 1*b*) fits precisely into a corresponding peripherally extending or even interrupted recess in the filler 6. Here, the one-piece common filler is fixed in its position for the above-mentioned cutouts laterally as well as in the plane of the guide bar.

Figure 8:
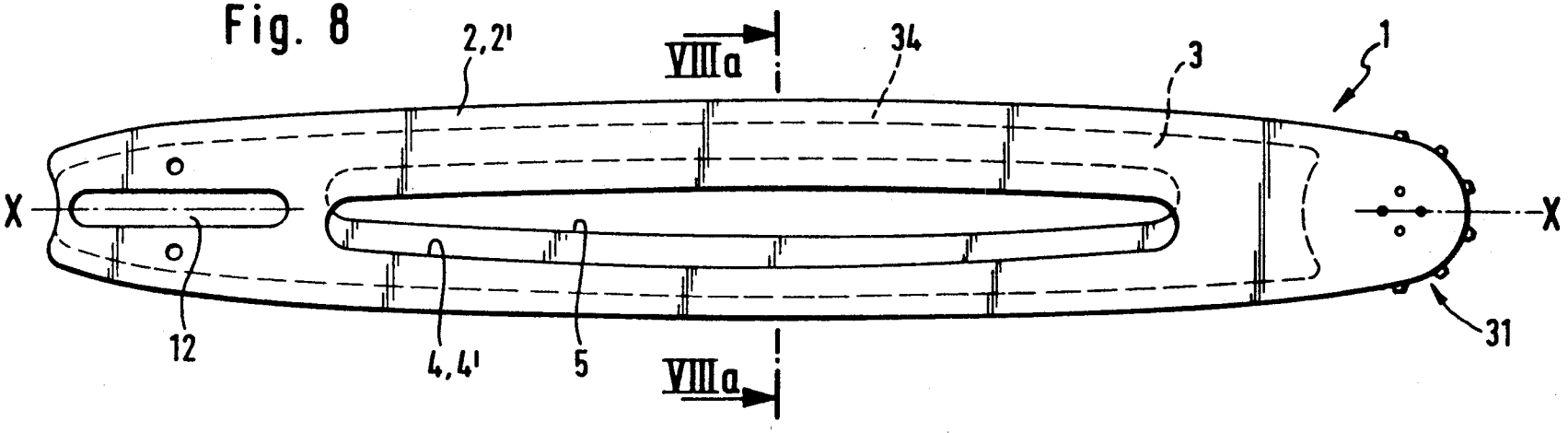
FIG. 8 is a side elevation view of still another embodiment wherein the non-coincidental position of the cutouts is achieved by offsetting the same in elevation.

FIG. 8 shows another embodiment of the invention wherein the cutouts (4, 4') of the side parts (2, 2') and the cutout 5 in the center part are configured so as to be symmetrically the same; however, they are offset with respect to each other in the direction transverse to the longitudinal axis of the guide bar.

Figure 6:
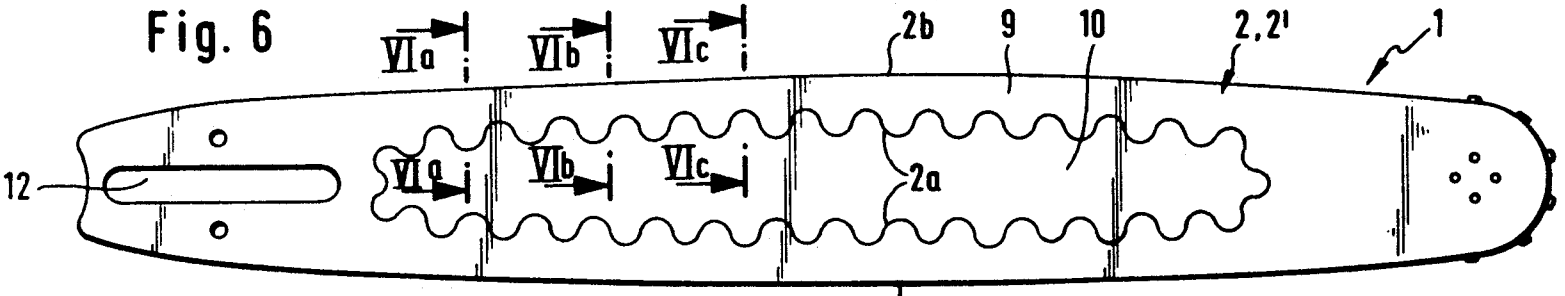
FIG. 6 is a side elevation view of another embodiment of the guide bar of the invention wherein the cutouts of the guide bar are likewise arranged so as to not coincide with each other.
Figure 7:
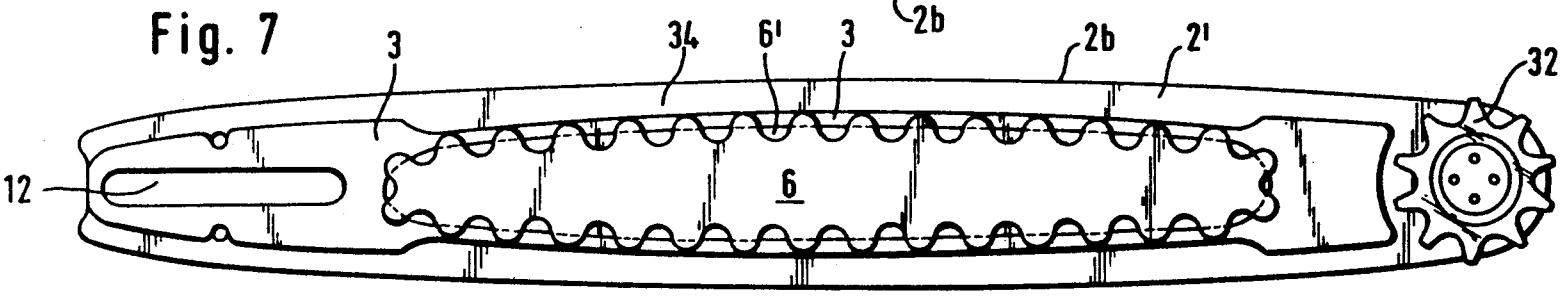
FIG. 7 is a view corresponding to that of FIG. 6 except that the forward side part 2 is not shown.

In the embodiment of FIGS. 6 and 7, component regions of the inner peripheral edge (2*a*, 2*a'*) of each of the two side parts (2, 2') have a contour trace which deviates from the outer edge (2*b*, 2*b*) of each side part (2, 2'). FIG. 6 shows a preferred embodiment wherein the inner peripheral edge 2*a* of the side parts (2, 2') is configured so as to be approximately sinusoidal in shape. The inner peripheral edge 2*a* can also be configured so as to have a meander-like shape or to define a zig-zag line or to have another similar shape. In this embodiment too, as in all embodiments, the cutouts (4, 4') in the side parts and/or the cutout 5 in the center part 3 are provided to extend over the largest possible length of the guide bar so as to be continuous.

Figure 2A:
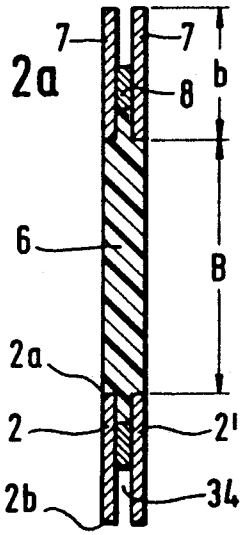
FIG. 2*a* is a section view taken along line IIa—IIa of FIG. 2.
Figure 2B:
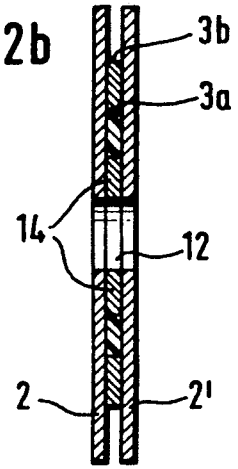
FIG. 2*b* is a section view taken along line IIb—IIb of FIG. 2.
Figure 3:
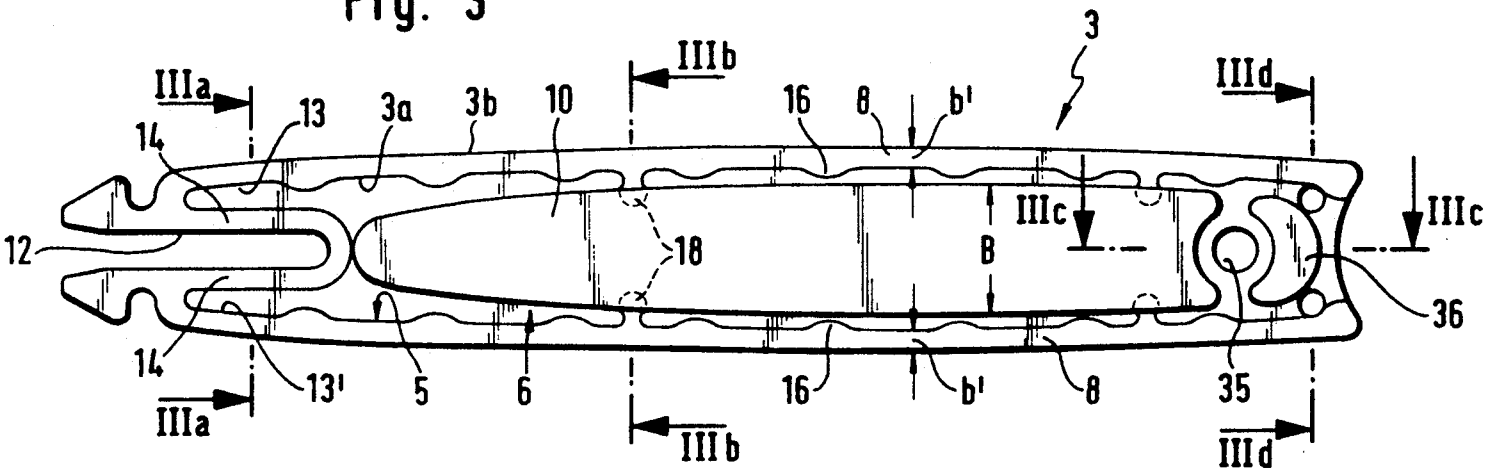
FIG. 3 shows the frame-shaped steel center part of the guide bar having a filler made of a light material.
Figure 4:
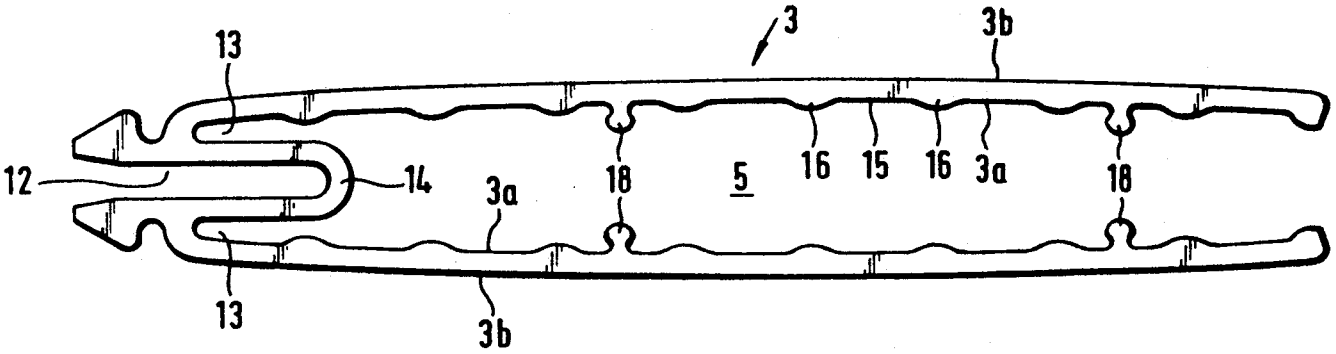
FIG. 4 shows an open stamped frame-shaped center part without a filler of light material.
Figure 5:
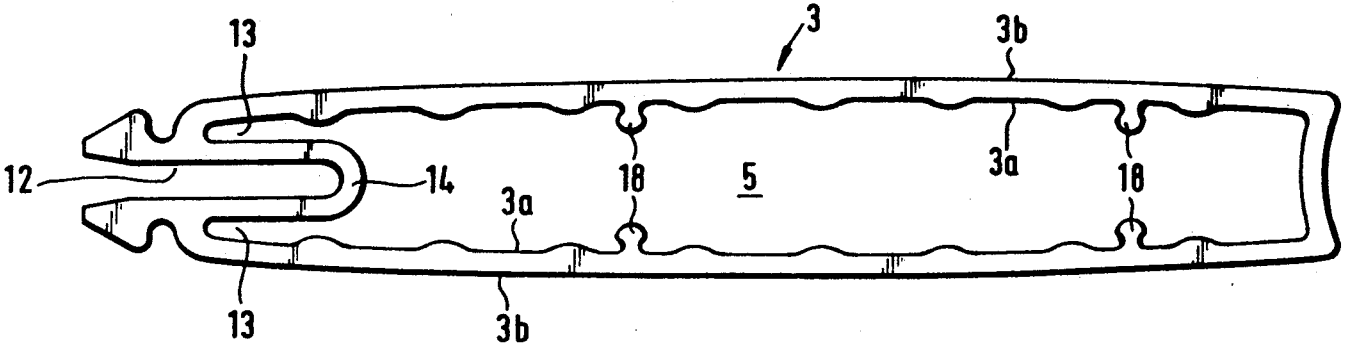
FIG. 5 shows a frame-shaped center part of a closed configuration.
Figure 5A:
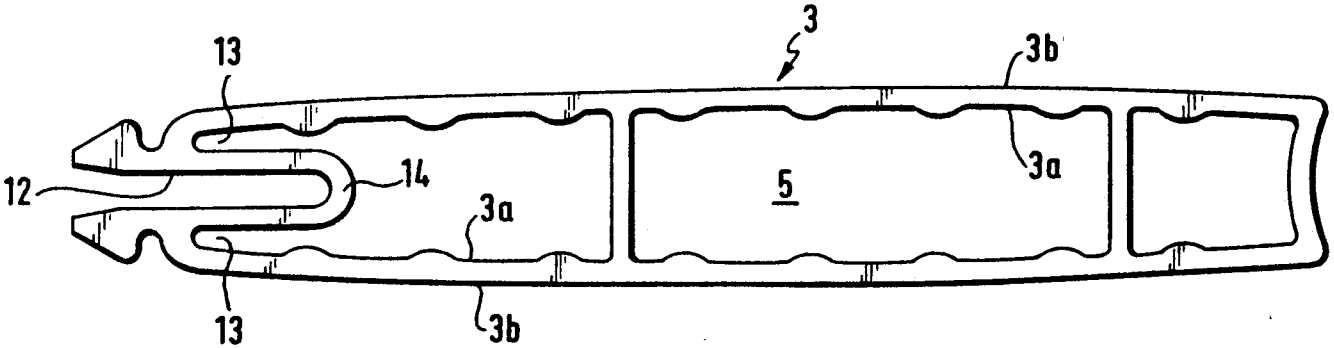
FIG. 5*a* shows the same frame of FIG. 5 except with connecting struts.

As shown especially in the embodiment of FIG. 2 (see the individual views of the center part in FIGS. 3, 4 and 5) but also shown in the other embodiments, an optimal savings in weight is obtained when the side parts (2, 2') and the center part 3 are configured as narrow frames having center sections which are configured only as struts 7 for the side parts (2, 2') and struts 8 in the center part. The widths (b) of each of the struts 7 are less than the width B of the cutouts (4, 4') in the side parts and in the center part 3. The struts (8, 8') of the center part 3 are then configured to be narrower than the struts (7, 7') in the side parts (2, 2') (see FIGS. 2, 2*a*, 2*b* as well as FIG. 3 and the section views corresponding thereto). An optimal savings in weight with adequate stability of the guide bar is obtained when each cutout (4, 4') in the side parts (2, 2') amounts to at least 50% of the overall surface of the side parts (2, 2'). The narrow frame-like center part having only struts (8, 8') on the longitudinal sides has primarily the function that the side parts (2, 2') are fixed at the required spacing for forming the guide groove 34 and to make possible the direct connection of all three parts (2, 2' and 3) via direct electric welding of these parts. For this reason, even further weight can be saved in the center part in that the cutout 5 is increased to approximately 80 to 90% of the overall surface of the center part 3.

A further optimization of the weight of the center part 3 is obtained when additional cutouts (13, 13') are provided parallelly to the attachment slot 12. These cutouts (13, 13') can be located at the attachment end 29 where the guide bar is mounted on the motor housing 22. The cutouts (13, 13') can be provided on both sides of the attachment slot 12, that is, above and below this slot (see especially FIGS. 3, 4 and 5) with the center part being configured as a frame or being configured to be strut-like and being made of steel. These cutouts (13, 13') are so configured that the attachment slot 12 is bounded only by a U-shaped strut 14. These additional cutouts (13, 13') are then filled with plastic in the same manner as the elongated cutout 5 of the center part and the cutouts (4, 4') in the side parts. The plastic can be a thermoplastic plastic, a thermoset plastic and/or a similar plastic. Preferably, the filler of all three bar parts (2, 2' and 3) comprises one and the same material. However, any other material having a light specific gravity is suitable for this purpose and can be used. Advantageously, the two lateral outer surfaces (10, 10') of the plastic filler 6 are configured so as to be even with the outer surfaces (9, 9') of the side parts so that friction and therefore wear will be prevented at the seam between the filler 6 and the outer surfaces (9, 9') of the side parts (2, 2') when cutting in wood.

Figure 9:
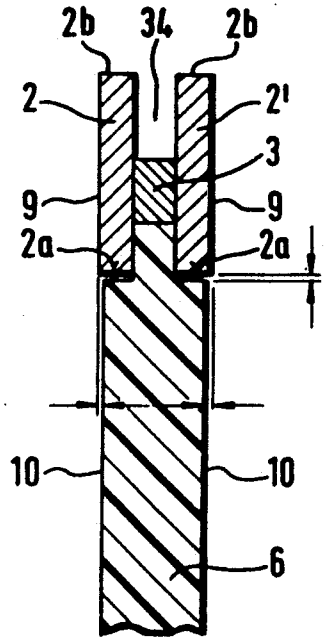
FIG. 9 is a section view taken perpendicular to the longitudinal axis of the guide bar wherein the outer surfaces of the plastic insert are slightly recessed with respect to the outer surfaces, of the frame-shaped side parts.
Figure 8A:
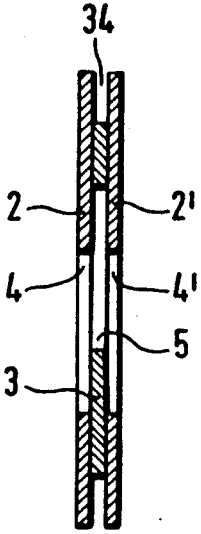
FIG. 8*a* is a section view taken along line VIIIa—VIIIa of FIG. 8.

A special embodiment is also provided which is not tied to the non-coinciding position of the cutouts in the three parts of the guide bar. In this embodiment, the outer surfaces (10, 10') of the plastic filler are recessed inwardly by preferably a fraction of a millimeter with respect to the outer surfaces (9, 9') of the side parts (2, 2') made of steel as shown in FIG. 9. This makes possible to apply an inscription on one or both outer surfaces of the filler 6 with this inscription filling out most of the surface. The outer surfaces of the inscriptions, in turn, extend planar to the outer surfaces (9, 9') of the side parts (2, 2'). The inscription (logo) can be printed, sprayed or applied in any other way to the filler, for example, by stamping.

Recessing the surfaces of the plastic filler makes possible that no or at most negligible friction occurs at the outer surfaces of the bar when cutting in wood notwithstanding an inscription which is made relatively large. At the same time, the condition is obtained that the inscription itself remains substantially protected from the wear during cutting because the outer surfaces (10, 10') of the filler 6 are recessed.

The joining of the side parts (2, 2') to the center part 3 can be performed in a suitable manner such as by cementing, preferably however, by welding and especially by electrowelding with the welds being configured as spot-shaped or line-shaped. As mentioned, the three frame-shaped metal parts (2, 2' and 3) can be welded together directly without an intermediate layer of electrically conducting individual parts such as bolts or the like. An advantageous weight reducing configuration is obtained if the inner edge 3*a* of the center part 3 has straight sections 15 (see FIG. 4) approximately parallel to the outer edge 3*b*. Cam-like projections 16 directed inwardly are provided between the sections 15 for the spot-shaped weld locations 17. As in the embodiments shown in FIGS. 2 to 5, the plastic filler 6 is fixedly injected or seated in a form-tight manner in advance of welding the center part 3 to the side part (2, 2') in such a manner that the filler 6 forms a fixed connection with the center part 3. For this condition, it can be advantageous to provide additional means, which holds the filler 6 in a back-cut manner with the means, for example, being mushroom-shaped holding elements (18, 18'). These holding elements can also have a dovetail configuration and can be cut out with the frame-shaped center part in one manufacturing step, for example, by stamping or by means of a laser beam.

The plastic filler 6 of the center part 3 can be prefabricated and thereafter seated in the stamped center part 3. If this procedure is followed, it is recommended to form latching recesses in the filler which form a simple snap connection with the projecting holding elements (18, 18') so that the insertable plastic filler 6 only has to be latched into the frame-shaped center part with the aid of this latch connection. In this way, in the same manner as with the injected plastic filler, a simple manipulation of the center part is ensured during the further processing steps even with the plastic filler seated in place.

The filler made of plastic can be injected in the frame-shaped center part 3. If this is done, then it is advantageous to provide a narrow air gap of approximately 0.5 mm between the inner edge 3*a* and the plastic filler 6 in order to protect the plastic filler 6 against damaging thermal influences. This narrow air gap can be provided by considering the shrinkage from the mold dimensions of the plastic used. The configuration of the air gap (g) is shown in FIG. 9.

Figure 3C:
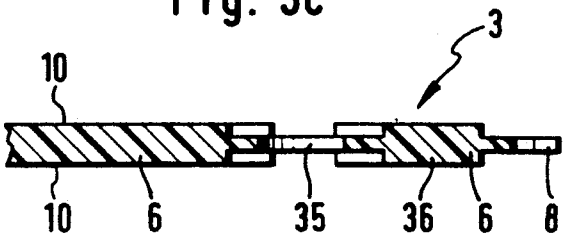
FIG. 3*c* is a section view taken along line IIIc—IIIc of FIG. 3.
Figure 3D:
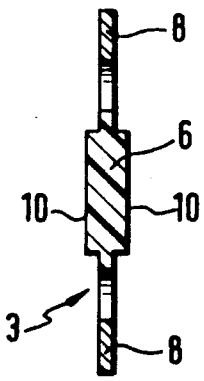
FIG. 3*d* is a section view taken along line IIId—IIId of FIG. 3.
Figure 3B:
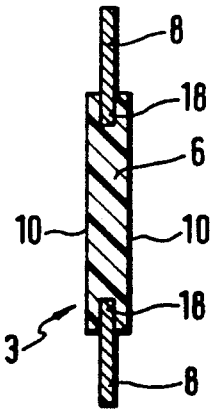
FIG. 3*b* is a section view taken along line IIIb—IIIb of FIG. 3.
Figure 3A:
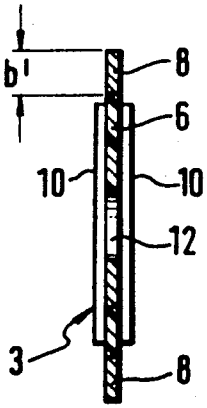
FIG. 3*a* is a section view taken along line IIIa—IIIa of FIG. 3.

FIGS. 2 and 2*a* to 2*c* schematically show the guide bar comprising three steel frames with a one-piece plastic filler which completely fills the cutouts (4, 4' and 5) as well as the slit-like cutouts (13, 13') on both sides of the attachment slot 12. In this connection, reference can be made to FIG. 3 and the corresponding section views of FIG. 3*a* to 3*d*. The free end section of the guide bar for the nose sprocket 32 can be seen in FIGS. 3, 3*c* and 3*d*.

A through cutout 35 is formed in the plastic filler 6 in the region ahead of this nose sprocket and within the center cutout 5. The cutout 35 is provided as a mounting location for a sharpening apparatus. A reinforcement 36 having a half-moon configuration is provided and is part of this mounting location in the center part 3 of the guide bar.

As already described, the side parts (2, 2') and the center part 3 are joined to each other by electrowelding. A spot weld is provided in the embodiment of FIG. 2.

Figure 10:
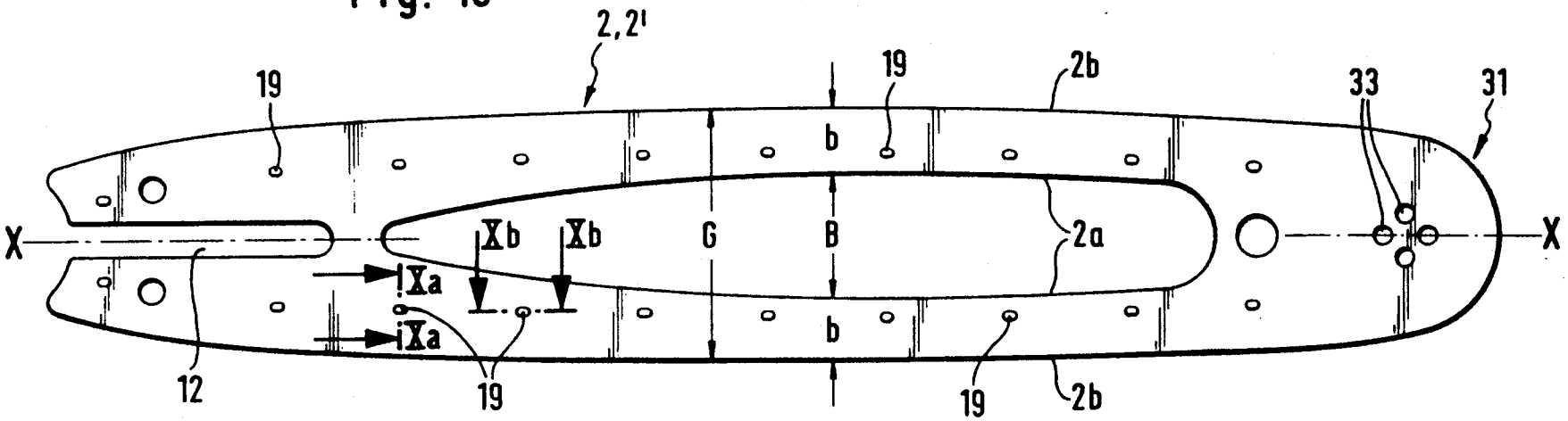
FIG. 10 is a side elevation view showing one side part of the guide bar having boss-like spot weld locations.
Figure 10B:
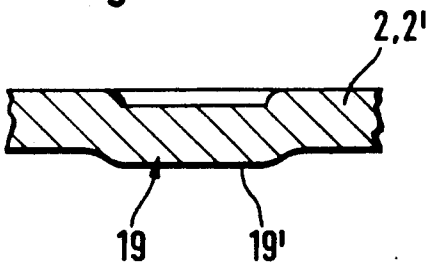
FIG. 10*b* is a section view taken along line Xb—Xb of FIG. 10.
Figure 10A:
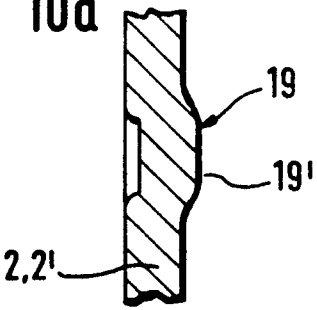
FIG. 10*a* is a section view taken along line Xa—Xa of FIG. 10.

Independently of the configuration of the guide bar as described, an especially advantageous embodiment for electrowelding the guide bar is shown in FIG. 2 in combination with FIGS. 10, 10*a* and 10*b*. This advantageous embodiment comprises that the two side parts (2, 2'), before welding to the center part 3, are provided with formed round and/or line-shaped projections 19 along the length of these parts (2, 2') in the region on both sides of the center axis X—X of the guide bar with these projections being directed inwardly, that is, toward the center part 3. These formed projections 19 are the electrowelding locations. In lieu of individual electrowelding spots, short or continuous line welds can be made with corresponding line-shaped formed projections being provided in the side parts to simultaneously limit the actual electroweld locations and for limiting the thermal influence zones during welding.

In a preferred embodiment as shown in FIG. 10, these formed projections 19' have an elongated or elongated-oval form with their longitudinal axes extending in the direction of the axis X—X of the guide bar. When compared to round projections of the same size, these oval-elongated formed projections 19' provide the advantage that the thermal influence zones in the struts (7, 7') and especially in the outermost narrow strut 8 of the center part 3, run in their longitudinal direction so that the struts themselves can be even configured narrower and therefore can be configured to save more weight whereby, in turn, an enlargement of the cutouts (4, 4' and 5) is possible. Finally, the projections themselves can be displaced as far as possible toward the edge of the guide bar. It has been shown that especially good results can be obtained when the weld spots have a spacing of 20 to 40 mm, preferably 30 mm, from each other and when they are further arranged such that they have an approximately equal spacing in elevation with respect to the peripheral edge 2*b* of the guide bar. The formed projections should extend approximately parallel to the outer edge 2*a* of the guide bar 1 also when they have a linearly-shaped configuration. The formed projections melt during electrowelding so that the surfaces of the parts (2, 2' and 3) welded to each other lie precisely flat one atop the other.

It has been further shown that optimal weight savings with adequate stability of the guide bar are obtained when the width (b) of the struts (7, 7') of the side parts (2, 2') has an approximate ratio of 1:4 to the overall width G of the side parts (2, 2'). The width b' of the center part 3 can then have a value relative to the overall G of the side parts which lies between 1:10 and 1:15.

In the embodiment of FIGS. 6 and 7, the non-coincidence is obtained in that at least component regions of the inner peripheral edge 2a of the cutouts in the side parts and/or in the center part 3 of the guide bar have a contour trace which deviates from the contour trace of the outermost edges (2b, 2b) of the side parts (2, 2') with this deviation being such that at least several individual sections of the peripheral edge 2a are arranged in the angle to the outermost edge trace 2b with the individual sections being preferably distributed uniformly over the entire inner periphery. In FIG. 6, the inner peripheral edge 2a is configured to be approximately sinusoidal or wave-shaped. The peripheral edge 2a can likewise be roof-shaped, sawtooth-shaped, meander-shaped or configured in other ways such that the cutouts (4, 4') of the side parts (2, 2') lie non-coincidentally (incongruently) to the cutout 5 of the center part 3.

Figure 6C:
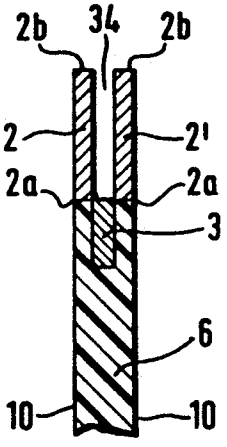
FIG. 6*c* is a section view taken along line VIc—VIc of FIG. 6.
Figure 6B:
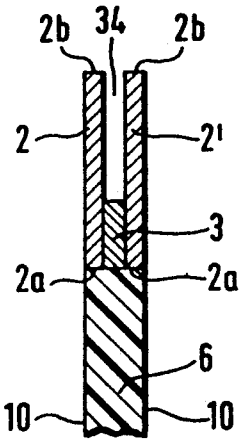
FIG. 6*b* is a section view taken along line VIb—VIb of FIG. 6.
Figure 6A:
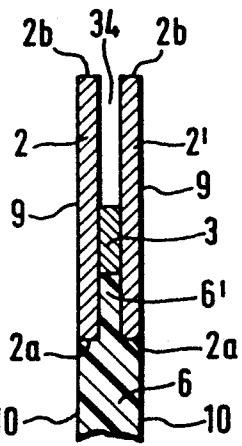
FIG. 6*a* is a section view taken along line VIa—VIa of FIG. 6.

The configuration shown in FIGS. 6 and 7 can be limited to the center part 3 of the guide bar with the cutouts (4, 4') having a trace in the side parts as shown in the embodiment of FIG. 2. In FIGS. 6a to 6c, it can be seen that the width of the side parts is different when viewed over the length of the guide bar corresponding to the sinusoidally-shaped contours of the inner edge 2a; whereas, the center part 3 has an outer and inner contour trace approximately the same as the embodiment of FIG. 2. The filler 6 completely fills out the cutouts in the side parts and in the center part with the filler 6 being held with a flange-shaped section 6' between the two side plates (2, 2') as shown, for example, in the section view of FIG. 6a; whereas, in the section view of FIG. 6b, the filler is flush with the inner edges (2, 2' and 3) so that here, in this section, the cutouts in all three machine parts coincide.

In the section view of FIG. 6c, the center part 3 is held in the manner of a tongue and groove connection. Overall, and over the periphery of the cutouts in the side parts and in the center part, a stable and fixed mesh-like mounting of the plastic filler results. In this embodiment, weld spots are advantageously positioned to correspond to a section of FIG. 6a in order to keep the thermal influence on the plastic filler as low as possible.

FIGS. 10, 10a and 10b show individual spot welding wherein the individual projections are configured so as to be elongated in order to keep their thermal influence zone as low as possible. The individual projections and therefore the spot welds themselves are here distributed uniformly and symmetrically to the X—X axis of the guide bar in the same manner as with a circular configuration of the individual projections. Their spacing from the outer contour of the guide bar is at least approximately equal. The weld locations have a spacing of approximately 30 mm in the longitudinal direction. This symmetrical arrangement of the weld spots imparts a high stability to the guide bar with the greatest possible saving of weight with the guide bar comprised of three narrow strut-like parts (2, 2', 3).

As shown in the detail section views of FIGS. 10a and 10b, the projections have linear segments which are parallel to the longitudinal axis X—X of the guide bar, which projections are joined by rounds to oval projections which makes possible that the individual projection-shaped weld locations can be placed as far as possible at the outer periphery of the guide bar. With the configuration provided by the invention, guide bars can be manufactured for which the side parts and the center part can have the narrowest possible longitudinal struts of a width between 3 and 5 mm. The strut width can be kept even smaller when the two struts of the side part or center part are connected by means of remaining braces.

The cutouts (4, 4' and 5) can be filled by means of injection or by placement. The filler 6 can then first be prefabricated together with the center part 3 to an independent part which affords the advantage that the production of the guide bar does not need special ancillary devices to ensure that the center part and the filler are held together. The side parts (2, 2') and the center part 3 provided with the filler 6 are then, as described, welded to each other by means of spot and line welding. It is however also conceivable that the individual parts are tightly connected to each other by means of a suitable adhesive.

In an alternate method for manufacturing the guide bar of the invention, the procedure can be followed in a simple manner that the plastic filler 6, which fills out the cutouts (4, 4') in the side parts (2, 2') and the cutout 5 in the center part 3, is only injected when the side parts and the center part are tightly welded to each other in the manner described or in another way.

It is understood that the foregoing description is that of the preferred embodiments of the invention and that various changes and modifications may be made thereto without departing from the spirit and scope of the invention as defined in the appended claims.

What is claimed is:

1. A guide bar for a motor-driven chain saw, the guide bar comprising:

first and second side parts;

a center part disposed between said first and second side parts;

joining means for joining said parts together in a sandwich configuration;

said first side part having a first cutout formed therein and having a first inner peripheral edge defining said first cutout;

said center part having a center cutout formed therein and having a center inner peripheral edge defining said center cutout;

said second side part having a second cutout formed therein and having a second inner peripheral edge defining said second cutout;

a filler filling out said cutouts and being made of a material lighter than the material of said side parts;

said first and second inner peripheral edges being disposed one adjacent the other so as to be congruent to each other and incongruent to said center inner peripheral edge so as to cause said inner peripheral edges to conjointly define holding means for fixedly holding said filler in said parts;

said first and second cutouts and said center cutout extending over most of the length of the guide bar;

said guide bar defining a longitudinal axis; and, said first and second side parts and said center part each being configured as a narrow elongated frame; each of the frames having a center region including upper and lower struts separated by the cutout of the part and said struts extending substantially in the direction of said axis; and, each of said struts having a width (b) less than the width B of the cutout of the part;

said first and second cutouts each constituting at least 50% of the overall area defined by said first and second side parts, respectively; and, said center cutout of said center part being approximately 80 to 90% of the overall area of said center part.

2. The guide bar of claim 1, said center cutout having a cross-sectional area greater than the cross-sectional area of each of said first and second cutouts so as to cause a peripheral slot to be formed between said first and second inner peripheral edges for holding said filler.

3. The guide bar of claim 1, said center cutout having a cross-sectional area greater than the cross-sectional area of each of said first and second cutouts so as to cause said center inner peripheral edge to project outwardly beyond said first and second inner peripheral edges and extend into said filler.

4. The guide bar of claim 1, said center cutout and said first and second cutouts all being geometrically the same and said center cutout being offset relative to said first and second cutouts.

5. The guide bar of claim 1, said side parts having respective first and second outer peripheral edges defining respective first and second outer contour traces; said first and second inner peripheral edges defining respective first and second inner contour traces; and, said first inner contour trace deviating from said first outer contour trace and said second inner contour trace deviating from said second outer contour trace.

6. The guide bar of claim 5, said first and second inner peripheral edges each defining a waveform.

7. The guide bar of claim 6, said waveform being a sinusoidal waveform.

8. The guide bar of claim 1, said first and second cutouts and said center cutout extending uninterrupted over most of the length of the guide bar.

9. The guide bar of claim 1, each of the struts of said center part being narrower than each of the struts of said first and second side parts.

10. The guide bar of claim 1. said filler being one and the same material in all of said cutouts; said first and second parts having first and second outer surfaces, respectively; and, said filler having respective outer surfaces extending at least approximately planar with said first and second outer surfaces.

11. The guide bar of claim 1, said filler being made of plastic and being injected into said center part.

12. The guide of claim 1, each of said struts of said side parts having a width (b) and each of said side parts having an overall width G; and, said width (b) and said overall width G defining a ratio of b/G of approximately 1:4.

13. The guide of claim 1, each of said struts of said center part having a width b' and said center part having an overall width G; and, said width b' and said overall width G defining a ratio of b'/G of approximately in the range of 1:10 to 1:15.

14. A guide bar for a motor-driven chain saw, the guide bar comprising:

first and second side parts;

a center part disposed between said first and second side parts;

joining means for joining said parts together in a sandwich configuration;

said first side part having a first cutout formed therein and having a first inner peripheral edge defining said first cutout;

said center part having a center cutout formed therein and having a center inner peripheral edge defining said center cutout;

said second side part having a second cutout formed therein and having a second inner peripheral edge defining said second cutout;

a filler filling out said cutouts and being made of a material lighter than the material of said side parts;

said first and second inner peripheral edges being disposed one adjacent the other so as to be congruent to each other and incongruent to said center inner peripheral edge so as to cause said inner peripheral edges to conjointly define holding means for fixedly holding said filler in said parts;

said first and second cutouts and said center cutout extending over most of the length of the guide bar;

said guide bar defining a longitudinal axis; and, said first and second side parts and said center part each being configured as a narrow elongated frame; each of the frames having a center region including upper and lower struts separated by the cutout of the part and said struts extending substantially in the direction of said axis; and, each of said struts having a width (b) less than the width B of the cutout of the part;

said first and second cutouts each constituting at least 50% of the overall area defined by said first and second side parts, respectively;

said center cutout of said center part being approximately 80 to 90% of the overall area of said center part;

said first and second parts having first and second outer surfaces, respectively; and, said filler having respective filler outer surfaces recessed slightly from said first and second outer surfaces, respectively, so as to permit inscriptions to be applied to said filler outer surfaces which are coplanar with corresponding ones of said first and second outer surfaces.

15. The guide bar of claim 14, said filler outer surfaces being recessed relative to corresponding ones of said first and second outer surfaces by a fraction of a millimeter.

16. A guide bar for a motor-driven chain saw, the guide bar comprising:

first and second side parts;

a center part disposed between said first and second side parts;

joining means for joining said parts together in a sandwich configuration;

said first side part having a first cutout formed therein and having a first inner peripheral edge defining said first cutout;

said center part having a center cutout formed therein and having a center inner peripheral edge defining said center cutout;

said second side part having a second cutout formed therein and having a second inner peripheral edge defining said second cutout;

a filler filling out said cutouts and being made of a material lighter than the material of said side parts;

said first and second inner peripheral edges being disposed one adjacent the other so as to be congruent to each other and incongruent to said center inner peripheral edge so as to cause said peripheral edges to conjointly define holding means for fixedly holding said filler in said parts;

said guide bar having a longitudinal axis; said guide bar further having a forward end portion and having a rearward end portion whereat the guide bar is mounted to the motor housing; said rearward end portion having an attachment slot formed therein extending substantially in the direction of said axis; said center part having ancillary cutouts formed therein at respective sides of said attachment slot and said center part including a U-shaped strut extending around the periphery of said slot; and, said filler being made of a material which fills out all of said cutouts.

17. A guide bar for a motor-driven chain saw, the guide bar comprising:

first and second side parts;

a center part disposed between said first and second side parts;

joining means for joining said parts together in a sandwich configuration;

said first side part having a first cutout formed therein and having a first inner peripheral edge defining said first cutout;

said center part having a center cutout formed therein and having a center inner peripheral edge defining said center cutout;

said second side part having a second cutout formed therein and having a second inner peripheral edge defining said second cutout;

a filler filling out said cutouts and being made of a material lighter than the material of said side parts;

said first and second inner peripheral edges being disposed one adjacent the other so as to be congruent to each other and incongruent to said center inner peripheral edge so as to cause said inner peripheral edges to conjointly define holding means for fixedly holding said filler in said parts;

said first and second cutouts and said center cutout extending over most of the length of the guide bar;

said guide bar defining a longitudinal axis; and, said first and second side parts and said center part each being configured as a narrow elongated frame; each of the frames having a center region including upper and lower struts separated by the cutout of the part and said struts extending substantially in the direction of said axis; and, each of said struts having a width (b) less than the width B of the cutout of the part;

said first and second cutouts each constituting at least 50% of the overall area defined by said first and second side parts, respectively;

said center cutout of said center part being approximately 80 to 90% of the overall area of said center part;

said center part having an outer peripheral edge; and, said center inner peripheral edge including: linear segments extending approximately parallel to said outer peripheral edge; and, a plurality of cam-shaped projections; one of said cam-shaped projections being disposed between each two adjacent ones of said linear segments for defining a spot-weld location for welding said center part and said side parts to each other.

18. A guide bar for a motor-driven chain saw, the guide bar comprising:

first and second side parts;

a center part disposed between said first and second side parts;

joining means for joining said parts together in a sandwich configuration;

said first side part having a first cutout formed therein and having a first inner peripheral edge defining said first cutout;

said center part having a center cutout formed therein and having a center inner peripheral edge defining said center cutout;

said second side part having a second cutout formed therein and having a second inner peripheral edge defining said second cutout;

a filler filling out said cutouts and being made of a material lighter than the material of said side parts;

said first and second inner peripheral edges being disposed one adjacent the other so as to be congruent to each other and incongruent to said center inner peripheral edge so as to cause said inner peripheral edges to conjointly define holding means for fixedly holding said filler in said parts;

said first and second cutouts and said center cutout extending over most of the length of the guide bar;

said guide bar defining a longitudinal axis; and, said first and second side parts and said center part each being configured as a narrow elongated frame; each of the frames having a center region including upper and lower struts separated by the cutout of the part and said struts extending substantially in the direction of said axis; and, each of said struts having a width (b) less than the width B of the cutout of the part;

said first and second cutouts each constituting at least 50% of the overall area defined by said first and second side parts, respectively;

said center cutout of said center part being approximately 80 to 90% of the overall area of said center part; and, said center part including a plurality of projections extending into said center cutout to define an expanding peripheral edge for forming a form-tight connection with said filler by permitting a portion of said filler to be disposed between a portion of the peripheral edge of said projections and said center inner peripheral edge.

19. The guide bar of claim 18, said projections each having a mushroom-like shape.

20. The guide bar of claim 18, said filler having a plurality of latch recesses; and, said latch recesses and said projections conjointly defining snap-connection means for holding said filler in said center part.

21. A guide bar for a motor-driven chain saw, the guide bar comprising:

first and second side parts;

a center part disposed between said first and second side parts;

joining means for joining said parts together in a sandwich configuration;

said first side part having a first cutout formed therein and having a first inner peripheral edge defining said first cutout;

said center part having a center cutout formed therein and having a center inner peripheral edge defining said center cutout;

said second side part having a second cutout formed therein and having a second inner peripheral edge defining said second cutout;

a filler filling out said cutouts and being made of a material lighter than the material of said side parts;

said first and second inner peripheral edges being disposed one adjacent the other so as to be congruent to each other and incongruent to said center inner peripheral edge so as to cause said inner peripheral edges to conjointly define holding means for fixedly holding said filler in said parts;

said filler being made of plastic and being injected into said center part; and, said center inner peripheral edge and said filler conjointly defining an air gap therebetween of approximately 0.5 mm.

22. A guide bar for a motor-driven chain saw, the guide bar defining a longitudinal axis and comprising:

first and second side parts;

a center part disposed between said first and second side parts;

said first side part having a first cutout formed therein and having a first inner peripheral edge defining said first cutout;

said center part having a center cutout formed therein and having a center inner peripheral edge defining said center cutout;

said second side part having a second cutout formed therein and having a second inner peripheral edge defining said second cutout;

a filler filling out said cutouts and being made of a material lighter than the material of said side parts;

said first and second inner peripheral edges being disposed one adjacent the other so as to be congruent to each other and incongruent to said center inner peripheral edge so as to cause said inner peripheral edges to conjointly define holding means for fixedly holding said filler in said parts;

said first part having a side surface facing said center part;

a plurality of first welding projections formed on said side surface on both sides of said axis;

said second part having a side surface facing said center part;

a plurality of second welding projections formed on said side surface of said second part on both sides of said axis so as to be disposed opposite corresponding ones of said first welding projections;

a plurality of welds for joining said side parts to said center part in a sandwich configuration;

said welds corresponding to each two mutually adjacent ones of said welding projections;

said first and second cutouts and said center cutout extending over most of the length of the guide bar;

said first and second side parts and said center part each being configured as a narrow elongated frame; each of the frames having a center region including upper and lower struts separated by the cutout of the part and said struts extending substantially in the direction of said axis; and, each of said struts having a width (b) less than the width B of the cutout of the part;

said first and second cutouts each constituting at least 50% of the overall area defined by said first and second side parts, respectively; and, said center cutout of said center part being approximately 80 to 90% of the overall area of said center part.

23. The guide bar of claim 22, each of said projections being a round projection.

24. The guide bar of claim 22, each of said projections being a linear projection.

25. The guide bar of claim 22, each of said projections being elongated and defining a longitudinal axis extending parallel to the longitudinal axis of said guide bar.

26. The guide bar of claim 22, each of said side parts having a peripheral outer edge, each two mutually adjacent ones of said projections being spaced 20 to 40 mm from each other; and, all of said projections being spaced approximately the same distance from said peripheral outer edge.

27. The guide bar of claim 26, each two mutually adjacent ones of said projections being spaced 30 mm from each other.

28. The guide bar of claim 22, each of said side parts having a peripheral outer edge; and, each of said projections being line-shaped projections extending substantially parallel to said peripheral outer edge.

* * * * *